US009834405B2

(12) United States Patent
Nikovski

(10) Patent No.: US 9,834,405 B2
(45) Date of Patent: Dec. 5, 2017

(54) METHOD AND SYSTEM FOR SCHEDULING ELEVATOR CARS IN A GROUP ELEVATOR SYSTEM WITH UNCERTAIN INFORMATION ABOUT ARRIVALS OF FUTURE PASSENGERS

(71) Applicant: Mitsubishi Electric Research Laboratories, Inc., Cambridge, MA (US)

(72) Inventor: Daniel Nikolaev Nikovski, Brookline, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 473 days.

(21) Appl. No.: 14/536,806

(22) Filed: Nov. 10, 2014

(65) Prior Publication Data

US 2016/0130112 A1 May 12, 2016

(51) Int. Cl.
*B66B 1/18* (2006.01)
*B66B 1/24* (2006.01)

(52) U.S. Cl.
CPC ..... *B66B 1/2458* (2013.01); *B66B 2201/102* (2013.01); *B66B 2201/211* (2013.01); *B66B 2201/233* (2013.01); *B66B 2201/234* (2013.01); *B66B 2201/235* (2013.01); *B66B 2201/402* (2013.01)

(58) Field of Classification Search
CPC ..... B66B 1/3407; B66B 2201/102; B66B 2201/211; B66B 2201/233; B66B 2201/234; B66B 2201/235; B66B 2201/402
USPC ..... 187/247, 380–389, 391, 392
See application file for complete search history.

(56) References Cited

U.S. PATENT DOCUMENTS 5,260,526 A * 11/1993 Sirag, Jr. ..... B66B 1/2408 187/382
5,260,527 A * 11/1993 Sirag, Jr. ..... B66B 1/2408 187/380
5,354,957 A * 10/1994 Robertson ..... B66B 1/2408 187/247

(Continued)

OTHER PUBLICATIONS

Bao, G.; 1994. Elevator dispatchers for down-peak traffic. Technical report, University of Massachusetts, Department of Electrical and Computer Engineering, Amherst, Massachusetts.

(Continued)

*Primary Examiner* — Anthony Salata
(74) *Attorney, Agent, or Firm* — Gene Vinokur; James McAleenan; Hironori Tsukamoto

(57) ABSTRACT

A method schedules elevator cars in a group elevator system in a building by first generating a set of probability distributions for arrivals of future passengers at any floor of the building, wherein the set of probability distributions are characterized by probabilistic variables that specify arrival information of the future passengers, wherein the arrival information includes a probability of service requests by the future passengers and a probability of possible times of the service requests. A schedule for the elevator cars is based on the set of probabilistic distribution. Then, the schedule is provided to a controller of the group elevator system to move the elevator cars according to the schedule.

20 Claims, 5 Drawing Sheets

(56) References Cited

U.S. PATENT DOCUMENTS 5,503,249 A * 4/1996 Virtamo ..... B66B 1/2458 187/380
6,394,232 B1 * 5/2002 Iwata ..... B66B 1/2458 187/247
6,672,431 B2 * 1/2004 Brand ..... B66B 1/2458 187/247
7,014,015 B2 * 3/2006 Nikovski ..... B66B 1/2458 187/247
7,484,597 B2 * 2/2009 Nikovski ..... B66B 1/18 187/247
7,546,905 B2 * 6/2009 Nikovski ..... B66B 1/18 187/247
8,220,591 B2 * 7/2012 Atalla ..... B66B 1/20 187/383
8,960,374 B2 * 2/2015 Nakagawa ..... B66B 1/2458 187/247
2003/0221915 A1 * 12/2003 Brand ..... B66B 1/2458 187/382
2013/0186713 A1 * 7/2013 Suzuki ..... B66B 1/2408 187/385

OTHER PUBLICATIONS

Nikovski et al., "Marginalizing out future passengers in group elevator control," Proceeding UAI '03 Proceedings of the Nineteenth conference on Uncertainty in Artificial Intelligence, pp. 443-450, 2003.

Suzuki et al., "Elevator supervisory control system with cars cooperative method," Proceedings of the ELEVCON'06 World Elevator Congress, pp. 338-346, 2006.

* cited by examiner

METHOD AND SYSTEM FOR SCHEDULING ELEVATOR CARS IN A GROUP ELEVATOR SYSTEM WITH UNCERTAIN INFORMATION ABOUT ARRIVALS OF FUTURE PASSENGERS

FIELD OF THE INVENTION

The invention relates generally to scheduling elevator cars in a group elevator system, and more particularly to assigning elevator cars to passengers with the help of uncertain information about arrivals of future passengers.

BACKGROUND OF THE INVENTION

Group elevator scheduling (GES) is a combinatorial optimization problem for a bank of two or more elevators. The most common instance of this problem deals with assigning elevator cars to passengers requesting an elevator car by means of an UP or DOWN button. In response to receiving the requests, a scheduler assign a car to each passenger so that a performance metric, for example an average waiting time (AWT) for all passengers, is minimized. The AWT is defined as a time interval from the moment a passenger makes the request until a car arrives, averaged over many requests. A large number of scheduling methods are known. However, there are significant obstacles to achieving an optimal AWT.

The first obstacle is the combinatorial complexity of the scheduling problem. If a building has an elevator bank with C cars and N passengers must be assigned to the cars, then there are $C^N$ possible assignments, each resulting in a different AWT. Even for a small number of cars and passengers, determining an optimal assignment by an exhaustive search of all $C^N$ assignments is not feasible, particularly given the relative short response times required. For this reason, multiple heuristic and approximate methods have been developed, see Nikovski U.S. Pat. No. 7,546,905, "System and method for scheduling elevator cars using pairwise delay minimization," U.S. Pat. No. 7,484,597, "System and method for scheduling elevator cars using branch-and-bound," U.S. Pat. No. 7,014,015, "Method and system for scheduling cars in elevator systems considering existing and future passengers, and U.S. 20030221915, "Method and system for controlling an elevator system." In U.S. Pat. No. 7,014,015, Nikovski describes a scheduling method where future requests are predicted at the main floor, and the waiting times for such future requests are included in the decision process. A shortcoming of that method is that only future requests at the main floor are considered.

The second obstacle to minimizing the AWT is due to incomplete, untimely and inaccurate information. For example, most hall call requests do not include a destination floor, but only an UP or DOWN direction. Typically, the destination floor is only indicated after the passenger enters the car. One approach of dealing with this problem is to assume a particular destination, for example, the last floor in the requested direction. A different approach determines the AWT for all possible destinations using a method to reduce the AWT with respect to arbitrarily selecting a single destination floor, see Nikovski et al., "Method and system for controlling an elevator system, U.S. Pat. No. 6,672,431. However, that method still cannot compensate for the lack of precise information. More advanced signaling mechanisms have been considered, including direct specification of the destination floor by means of an input panel outside the elevator for Destination Control (DC) scheduling. As a significant disadvantage, this increases the cost of the system, and is typically only used at the main floor, if at all.

A third obstacle is the inability to predict future requests and destinations. Typically, the scheduler can only service known requests and destinations. As a result, most schedulers use an empty-the-system algorithm (ESA), see Bao et al., "Elevator dispatchers for down-peak traffic," Technical report, University of Massachusetts, 1999. In ESA schedulers, all future passenger arrivals are ignored, which is an obvious inaccuracy with respect to what will actually happen to the elevator system. A major problem with the ESA is its inability to predict future requests. In effect, the ESA makes a schedule that can result in all cars being positioned in only one small part of the building, leaving large parts uncovered. The reason for this is that all terminal positions of the cars are considered equally good, as long as no passengers are waiting so there is no reason to prefer one position over another.

Conventional GES systems typically deal with the lack of information and limited computing resources by simplifying the optimization problem. Several simplification can be used.

In one method, mutual delays due to the assignment of two or more passengers h to the same car are ignored. The selected car is $c^*=\mathrm{argmin}_c W_c(h|\emptyset)$, where $W_c$ is a function that expresses the waiting time of one or more passengers given that another set of zero or more passengers are also assigned to the same car, and Ø is the null set. This simplification reduces the scheduling problem to selecting the car that minimizes the waiting time W for passenger h, regardless of whether other passengers have been or will be assigned to the same car. That method ignores the delays that existing passengers assigned to the same car would cause to the current passenger, as well as the delays the current passenger making the request and to be scheduled would cause to the existing passengers.

The most common scheduling method used in conventional GES systems accounts for interdependence of assigned passengers, but ignores future passengers. That method determines the best possible assignment for passengers that have requested service, but have not boarded a car yet. Because AWT minimization reduces to finding an assignment that would load the existing passengers into cars as fast as possible, this kind of methods are also known as empty-the-system-methods (ESA). Let H(t) represent the set of passengers who have arrived by time t, but have not been served yet and are still waiting. Then, the goal is to find assignments for the passengers in H(t) that minimizes their cumulative waiting time W (H(t)) .

In an immediate assignment mode, the assignment for the current passenger h is made immediately and never reconsidered. In this mode, it is sufficient to determine a marginal waiting time $$\Delta W_c(h) \doteq W_c(h \cup H_c(t) | h \cup H_c(t)) - W_c(H_c(t) | H_c(t))$$

for each car c, and assign h to the car with the shortest marginal waiting time $\Delta W_c(h)$. That is, the scheduler tentatively assigns the passenger h to each car in turn, and selects the car that marginally increases the waiting time. The marginal increase in the waiting time can be written as $$\Delta W_c(h) = W_c(h|H_c(t)) + \Sigma_{g \in H_c(t)} [W_c(g|H_c(t) \cup h) - W_c(g|H_c(t))],$$

where g ranges over all passengers in the set $H_c$.

The first term in the marginal increase is the time needed to serve the passenger h with car c. It also accounts for stops that car has to make due to other passengers in the set $H_c(t)$ already assigned to car c. The remaining terms in the sum account for the increase in waiting time passenger h causes to the passengers already in the set $H_c(t)$, when also assigned to c.

In a reassignment mode, any passenger's assignment could be reassigned at any time when new information is received, including, but not limited to, new arrivals. Effectively, the total waiting times W(H(t)) for every possible assignment is predetermined, but for the passengers in the set H(t), ignoring past and future passengers. Although the resulting set is much smaller than the set H, an exhaustive search is still rarely feasible.

Some methods consider future arrivals at the main floor. Even this limited consideration of future arrivals can result in considerable reduction of the AWT during, for example, a peak up traffic time in the morning, see U.S. Pat. No. 7,014,015, "Method and system for scheduling cars in elevator systems considering existing and future passengers." As a limitation, that method only considers future arrivals at a single (main) arrival floor, such as a building lobby.

Another practically beneficial method for consideration of future arrivals is described by Suzuki et al. in U.S. 20130186713. An elevator system parks empty cars at floors having a high frequency of use. The system includes a remote call device to perform a hall call registration at a distance from the elevator. The time for moving the elevator car from the parking floor is compared with the walking time to elevator. A determination is made whether or not to perform a standby operation based on the result of the comparison of the times.

Suzuki et al., "Elevator supervisory control system with cars cooperative method," Proceedings of the ELEVCON'06 World Elevator Congress, pp. 338-346, 1206, simulate an imaginary additional request at each floor for each real request, and the best schedule that can handle both real and imaginary requests, even for a most unfavorable floor for the imaginary request, is selected. While that method significantly improves over the ESA methods, the method still considers only one future request, and the time of the imaginary and actual requests are coincident.

In U.S. Pat. No. 8,220,591, Attala et al. describe a scheduling method for a group of elevators using advance traffic information. The advance traffic information is used to define a "snapshot" problem to improve performance for passengers. To solve the snapshot problem, an objective function is transformed to facilitate the decomposition of the problem into individual car subproblems. The subproblems are independently solved using a two-level formulation, with passenger to car assignment at a higher level, and the dispatching of individual cars at a low level. The primary disadvantage of that method is that future arrivals are assumed to occur with complete certainty, e.g., requests are made on a keypad located at a distance from the elevators, cameras or other sensors in corridors leading to the elevators detest approaching passengers, identification card readers or a hotel conference schedule system supply arrival information at an increased costs. However, complete certainty still cannot be reasonably expected in an actual practical system.

It is desired to provide an optimal scheduling strategy for group elevator systems that takes advance information about uncertain future passenger arrivals into consideration.

SUMMARY OF THE INVENTION

The embodiments of the invention provide a method and system for scheduling elevator cars in a group elevator system of a building, and more particularly to assigning elevator cars to passengers using uncertain information about arrival times of future passengers at any floor of the building. It is an objective of the invention to determine a schedule for the elevator cars that optimizes a performance metric, for example, an average waiting time (AWT) for all passengers. Furthermore, it is desired to perform the scheduling in real time.

The embodiments use information about expected arrivals of future passengers, and consider the uncertainty in that information. The invention can also operate in an immediate assignment mode. This means that every time a request for an elevator car is received, the car that services the passenger is determined immediately, and the request is not reconsidered. The scheduling also considers arrival information stored in a table. The arrival information can include data acquired by sensors located in the building, and arrival statistics such as the probability of service requests by the future passengers and the probability of possible times of the service requests.

The possible arrival times of the future passengers are represented by probabilistic variables, e.g., using a statistical distribution such as a Gauss-Bernoulli distribution, a Poisson distribution, a Weibull distribution, or another appropriate distribution. The probabilistic variables can be based on past passenger arrival information, as well sensed presence of potential passengers in other parts of the building. The probabilistic variables can be parameterized by a probability distribution of arrival floor and time of arrival. This probability distribution can have a specific parametric form, such as a Gaussian distribution, a Weibull distribution, etc. Passengers who have not been sensed, but could arrive within a future time interval, are characterized by an arrival rate, under the assumption of a Poisson arrival process, where the times between arrivals come from an exponential distribution.

Based on the arrival information, the scheduler can generate multiple possible continuation sets, e.g., by drawing samples from the Gauss-Bernoulli or Poisson variables for the future passengers. Then, the scheduler determines the optimal car assignment for the passenger that has just arrived by averaging the AWT of all passengers over all continuation sets, after finding suitable assignments for all future passengers in the continuation sets.

For a recently arrived passenger, the car assigned to the passenger is the same over all continuation sets, but for future arrivals, a passenger sampled from the same entry in the table of arrival times of future passengers does not necessarily have to be assigned to the same car over all continuation sets.

In the preferred embodiment, future passengers are assigned to cars using an immediate assignment mode, where every passenger is assigned in the order of arrival, and assignment takes into consideration passengers arrived so far, but ignores passengers who arrive later in the continuation set. In another embodiment, all future passengers are assigned jointly, such that every passenger's assignment takes into consideration assignments of all other passengers, regardless of whether the other passengers arrived before or after that passenger.

DETAILED DESCRIPTION OF THE PREFERRED EMBODIMENTS

General Scheduling Method

Figure 1A:
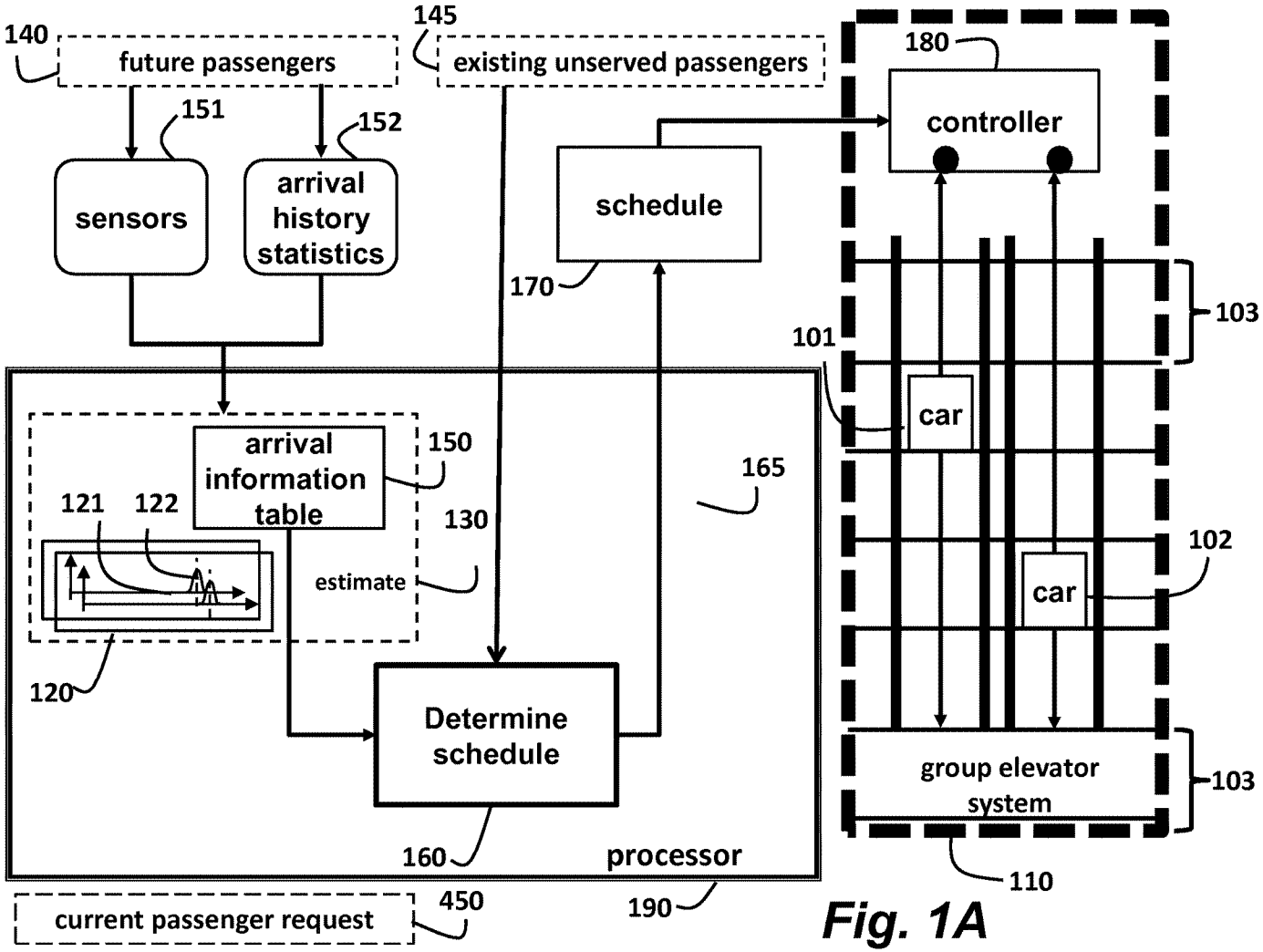
FIG. 1A is a block diagram of a method and system for scheduling elevator cars—102 in a group elevator system for passengers.

FIG. 1A shows a block diagram of a method and system for scheduling elevator cars 101-102 in a group elevator system 110 in a building having multiple floors 103. A set of probability distributions 120 of realized arrivals of future passengers 140 is estimated 130.

Future passengers are those passengers that have not made a request for service by pressing an UP or DOWN button. At the time of the current request, all future passengers are imagined. The set of probability distribution 120 is characterized by probabilistic variables that specify the uncertain process of future arrivals, e.g., a probability of service requests 121 by the future passengers and a probability of possible times 122 of the service requests. The information can be obtained from sensors 151 or arrival history statistics 152.

The set of probability distribution is stored in an arrival information history table 150. Any time a new current passenger request for service 450 is registered, samples from the probability distributions 120 stored in that table 150 are drawn, and combined with the existing unserved passengers 145 to generate continuation sets that are used to determine 160 a suitable schedule 170 for both existing and potential future passengers. It is understood that the schedule includes passengers whose arrival time is known because an UP or DOWN button has been pressed to make a request for service. The continuation sets are described in greater detail below with reference to FIG. 4.

The method operates continuously and in real time.

Realized Future Arrival Times

Following is an example scenario that explains realized future arrival times according to embodiments of the invention. A potential future passenger, with a probability p=0.7 of requesting service, is sensed at a remote location at 10:00:00 am. Suppose that the distance between the remote location and the elevator landing is 20 m, and the average walking speed of passengers is 1 m/s, but due to variations among different people, it can vary by 15%. Then, the time for this passenger to move to the elevator landing is 20 seconds±3 seconds. Under the assumption of normal (Gaussian) distribution of walking speed across the general population, a Gauss-Bernoulli variable for this passenger can be stored in the arrival information table 150, with probability p=0.7, mean $\mu$=20 s, and standard deviation $\sigma$=3 s. This means that the expected time of his arrival at the elevator is 10:00:20.

However, there is uncertainty in the expected time, e.g., ±3 seconds. Although, this may seem like a very small amount of time, it is noted that modern elevators can travel at speeds exceeding 15 msec. So the elevator could pass dozens of floors of waiting passengers in that time.

In order to schedule under this uncertainty, we form n=3 continuation sets, by randomly sampling from the Gauss-Bernoulli variable. Suppose that in the first continuation, the arrival time ends up being 10:00:22, in the second continuation it is 10:00:19, and in the third continuation the passenger does not arrive at all. When scheduling the passengers in a continuation set, we order the sets by their sampled (realized, actuated) arrival times. For the passenger in the first continuation case, this would be 10:00:22, and not the expected time 10:00:20.

By implementing the method, when scheduling actual passenger arriving in the near future, their assignment will take into consideration the possible arrival of this sensed passenger around 10:00:20, and this assignment would be robust with respect to the possible variations in this passenger's arrival times, as manifested in the different sampled arrival times in the three continuations.

Sensors

The sensors 151 can be installed in areas from which the future passengers can arrive. For example, the sensors can be motion detectors. Specific types of motion sensor can include cameras, such as surveillance cameras that are commonly located in corridors and hall on the various floors in the building, or proximity sensors that directly detect human motion. The floor can include above or below ground parking level floors.

The sensors can be used to detect the people at multiple locations in a building, and not necessarily only at elevator doors or corridors leading to the elevators. In such a case, when a person is detected at location l, e.g., in a hallway fifty meter away from the elevator landing, the probability $p_i$ that the person will request elevator service can be determined by correlating sensed data with actual service requests.

Historical Information

The historical information obtained from, e.g., from UP and DOWN request at particular floors for specific times of day, days of the week, can be used to adjust the most recently observed actual arrival rates. Such predictive information can result in a reduction of the AWT when used with the predictive scheduler as described herein.

Probabilitic Model

Figure 1B:
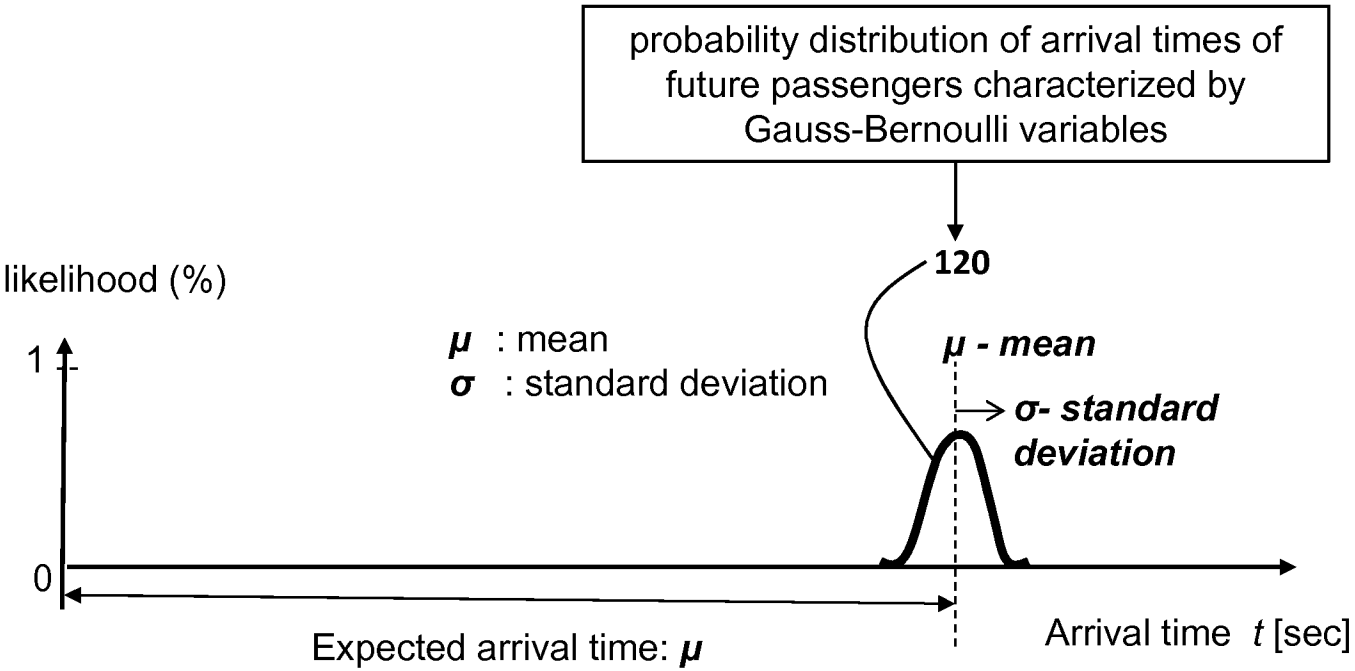
FIG. 1B is a schematic of a probability distribution model of arrival times of future passengers characterized by probabilistic variables in the form of Gauss-Bernoulli variables.

As shown in FIG. 1B, a physical model can also be used to construct a probabilitic model of the probability of possible times of the service requests. Let $\mu_l=s_l/v$ be the time to travel a distance of length $s_l$ between the sensing location l and the elevator door at a velocity v, for example, 1 meter per second. Then, for any person sensed at location l, a passenger's realized arrival time and request for service can be determined from the probability distribution 120 with probability $p_l$, in time $\Delta t$ sampled from a suitable distribution, for example, a Gaussian distribution $t:N(\mu_l,\sigma_l^2)$ with a mean $\mu$. The variance $\sigma_l^2$ can also be obtained from data acquired by the sensors.

The probability distribution is used to generate 160 a schedule 170. The schedule can then be provided to a controller 180 of the group elevator system 110 to move the elevators according to the schedule. The steps can be performed by a processor 190 designed to operate the group elevator system using the controller 180. The processor and controller can be connected by a communications link 165.

As an advantage, the invention can schedule the elevators cars for the future passengers so that the arrival of the elevator cars and the future passengers approximately coincide at the various floors to minimize the average waiting times.

Group Elevator Scheduling

One objective of a group elevator scheduling (GES) system is to minimize an average waiting time (AWT) for all passengers that request elevator from a current time and during a future time interval. If the interval is finite, and an exact arrival sequence of the passengers is known, then it is possible, at least in theory, to determine optimal assignments of cars to passengers that minimize the AWT.

For a set H of passengers $\{h_1, h_2, \ldots, h_N\}$ arriving during an interval of time, a passenger $h_i$ can be represented by a tuple $(t_i, o_i, d_i)$, where $t_i$ is the arrival time, $o_i$ is the arrival floor, and $d_i$ is the destination floor. An assignment of the N passengers to C cars in a bank partitions the set H into C subsets $H_c$, such that $H=H_1 \cup H_2 \cup \ldots \cup H_C$, and $H_i \cap H_j$ is the null set Ø when $i \neq j$.

A waiting time for a passenger h in a set A assigned to a car c is $W_c(h|A)$ when all passengers in the set A are assigned to the car c. Similarly, a cumulative waiting time for all passengers in the set H is $W_c(H|A)$, when all of those passengers are assigned to car c. The sets H and A are not necessarily the same.

In general, the waiting time $W_c(H|A)$ depends on a predetermined order in which the car c services the passengers in the set $H \cup A$. Most elevator systems use a full collective policy where a car services all requests in one direction in sequence and then reverses and answers all calls in the opposite direction. When the car is empty and stopped, possible UP and DOWN directions are compared, and the one resulting in a shorter AWT is selected. Other possible service sequences that optimize the AWT are also possible. But regardless of the method selected, the resulting waiting time of $W_c(H|A)$ can be completely determined for a given combination of the sets H and A and the position of car c.

For a given full assignment, the total waiting time W(H) for all passengers in the set H can be expressed as $$W(H) = \sum_{c=1}^{C} W_c(H_c \mid H_c) = \sum_{c=1}^{C} \sum_{h \in H_c} W_c(h \mid H_c), \tag{1}$$

and the AWT of the passengers in the set H is W(H)/N. There are $C^N$ possible partitions of the set H into C subsets. With unlimited computational resources and/or a suitable combinatorial optimization method, the optimal assignment could perhaps be determined.

However, even if such a computation was possible, there is a much more severe difficulty resulting from insufficient information. In practice, the GES system has only limited access to arrival information. At the current time t, somewhere within the time interval $(t_1<t<t_N)$, the GES only has information about all request that occurred up to the current time t and states of the C cars in the bank.

The typical conventional art GES system does not have access to future arrival events. In Destination Control (DC) scheduling, the request information for passenger $h_i$, $t_i<t$ includes the destination floor $d_i$. For a conventional non-DC systems, that information is not available, and only the desired direction of motion $u_i=\text{sign}(d_i-o_i)$ of passenger $h_i$ is available. Moreover, when a passenger arrives at an elevator where other passengers are already waiting, the newly arrived passenger usually does not press the UP or DOWN button if the button has already been selected. This effectively "hides" the arrival of those new passenger from the system.

Passengers Arriving in the Future

Figure 2:
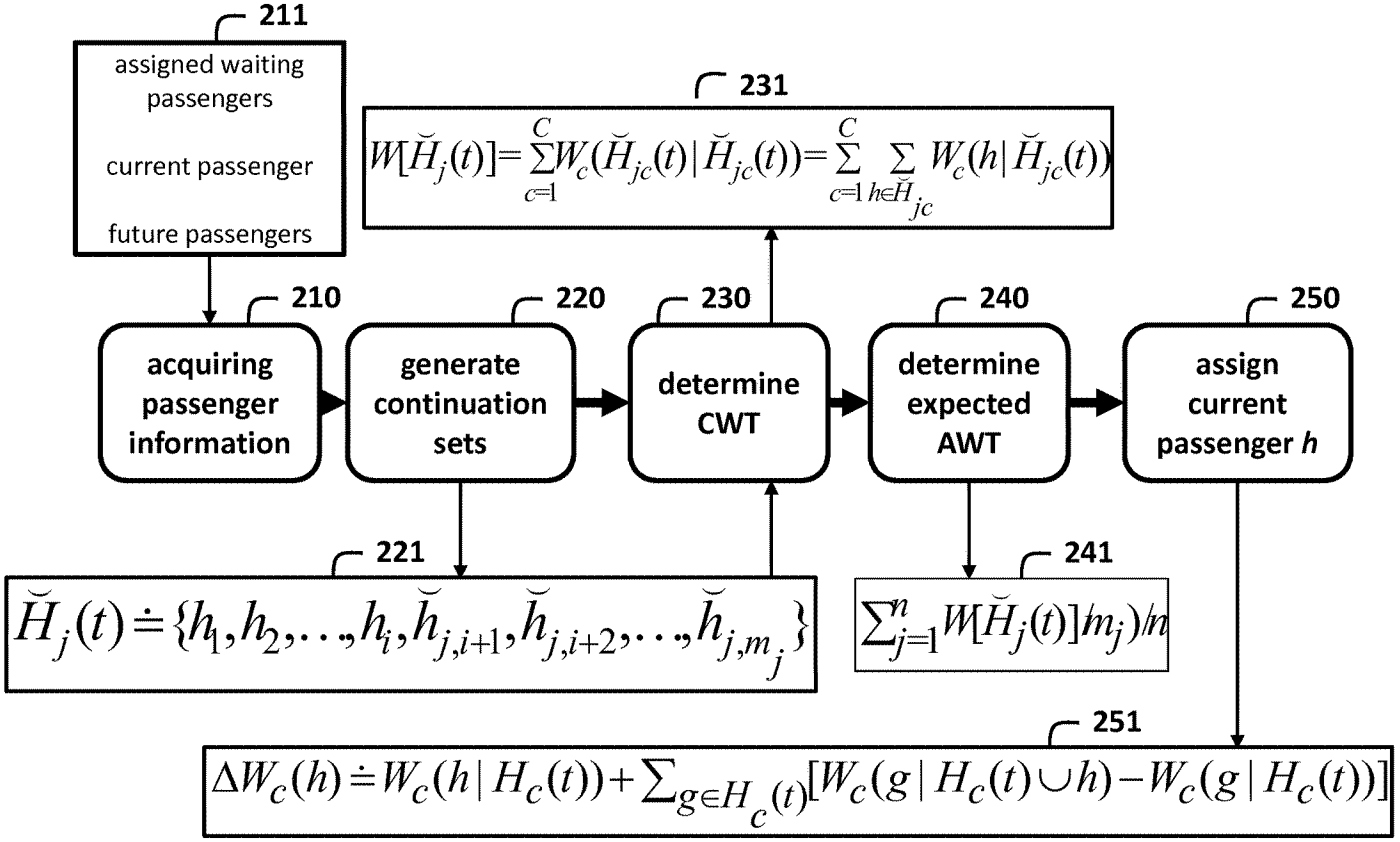
FIG. 2 is a flow diagram of a method for scheduling passengers in a group elevator system according to embodiments of the invention.

As shown in FIG. 2, one way to improve performance of the GES is to predict the intentions of the future passengers 140. Although this is impossible in practice, one can still acquire 210 available passenger information 211. The arrival information can include historical information 152 about assigned waiting passengers, a current requesting passenger, and future passengers 140, e.g., information sensed by sensors 151.

Figure 3:
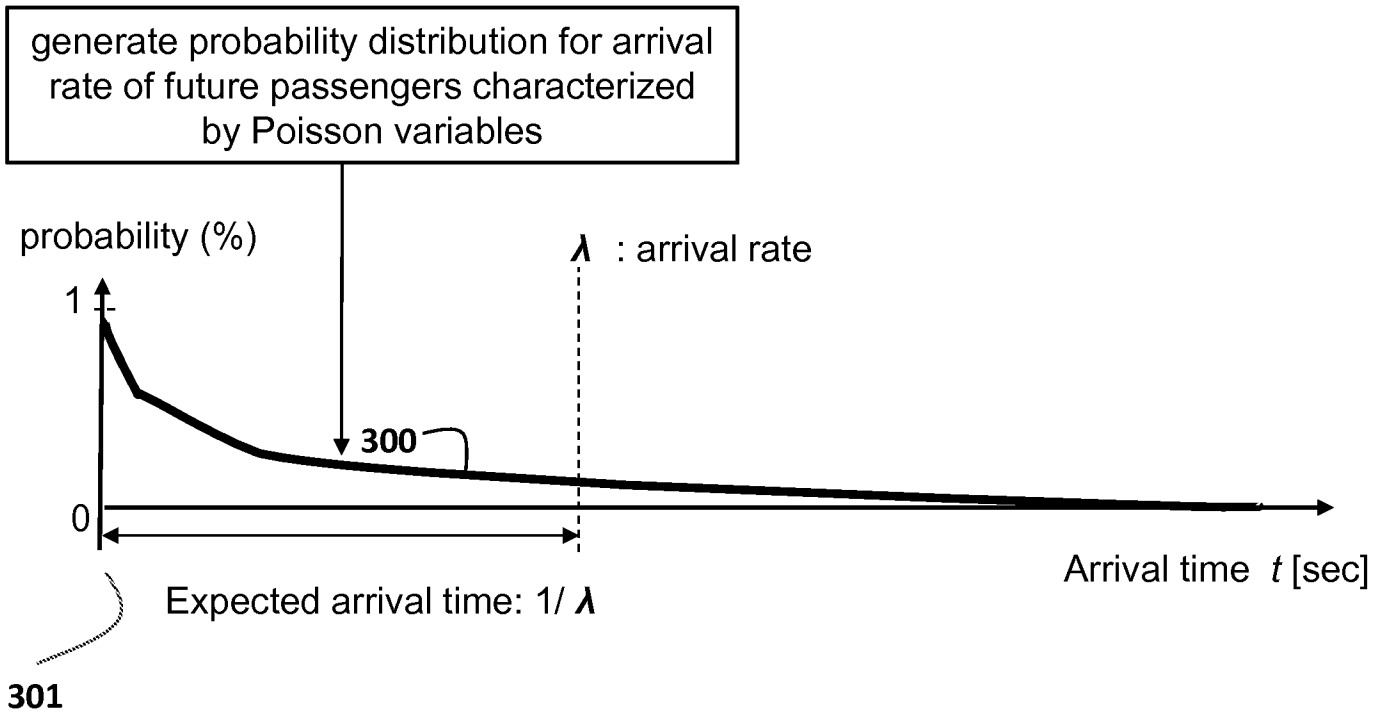
FIG. 3 is a schematic of an exponential probability distribution for arrival times of future passengers not sensed, characterized by a Poisson arrival process according to embodiments of the invention.

For times $t_i<t<t_{i+1}$ between arriving passengers $h_i$ and $h_{i+1}$, it is possible to generate 220 n possible continuation sets $\check{H}_j(t)$ 221, $1 \leq j \leq n$ of passengers that have arrived and that can possible arrive in the future, see FIG. 3 for detail of passengers and timing.

As defined herein, a continuation set 221

$$\check{H}_j(t) \doteq \{h_1, h_2, \ldots, h_i, \check{h}_{j,i+1}, \check{h}_{j,i+2}, \ldots, \check{h}_{j,m_j}\}$$

includes information 211 about:

historically known assigned passengers h waiting for a car;

current passenger h making a request; and unknown future passengers $\check{h}$.

Here, $\check{h}_{j,i+k}$ is the $k^{th}$ future passenger in continuation set $\check{H}_j(t)$. The number $m_j$ of passengers in each continuation sets can be different. Note that the existing passengers in all continuation sets are identical, that is, all continuations share the same past, but have different futures.

Depending on computational resources and passenger arrival rates, a length l of time of the continuation sets can vary, e.g., from minutes to hours. Then, for each continuation set $\check{H}_j(t)$, it is possible to determine 230 an optimal cumulative waiting time (CWT) 231 similarly to equation (1):

$$W\left[\check{H}_j(t)\right] = \sum_{c=1}^{C} W_c\left(\check{H}_{jc}(t) \,\middle|\, \check{H}_{jc}(t)\right) = \sum_{c=1}^{C} \sum_{h \in \check{H}_{jc}} W_c\left(h \,\middle|\, \check{H}_{jc}(t)\right), \tag{2}$$

where $\check{H}_{jc}(t)$ denotes the set of passengers in continuation set $\check{H}_j(t)$assigned to car c. The AWT for that assignment can be determined 240 as $$\Sigma_{j=1}^{n} W[\check{H}_j(t)]/m_j)/n241. \tag{3}$$

Although this computation is over n continuation sets, as opposed to only one set of passengers as in equation (1), it would not necessarily take more time. Equation (2) involves the entire arrival stream, possibly over a very long interval of time. However, the duration of the n continuation sets can be adjusted according to the available computational resources.

Special care is taken that in all n continuation sets, the passengers $h_i$ with arrival times $t_i<t$ are assigned to the same car in every continuation set. Outside of this consideration, any practical method for minimizing the AWT, e.g., an empty-the-system method, can be used Immediate assignment and reassignment modes can be used.

Immediate Assignment

In this mode, the current passenger h is tentatively assigned 250 to car c with a marginal waiting time (MWT) 251

$$\Delta W_c(h) \doteq W_c(h|H_c(t)) + \Sigma_{g \in H_c(t)}[W_c(g|H_c(t) \cup h) - W_c(g|H_c(t))], \tag{4}$$

where g ranges over all passengers tentatively assigned to car c.

Note that future passengers are ignored in the first term. However, this assignment has an effect on the waiting time of future passengers $\check{h}_{j,i+k}$, when their marginal waiting times are determined as $$\Delta W_c\left(\check{h}_{j,i+k}\right) \doteq W_c\left(\check{h}_{j,i+k} \mid \check{H}_{jc}(t_{i+k-1})\right) + \sum_{g \in \check{H}_{jc}(t_{i+k-1})} \left[W_c\left(g \mid \check{H}_{jc}(t_{i+k-1}) \cup \check{h}_{j,i+k}\right) - W_c\left(g \mid \check{H}_{jc}(t_{i+k-1})\right)\right],$$

where $\hat{H}_{jc}(t_{i+k-1})$ denotes the set of future passengers that have arrived before time $t_{i+k}$, and have already been assigned to car c.

Then, the current passenger h is tentatively assigned to one of the continuation sets $\check{H}_{jc}(t_{i+k-1})$, and one can account for the mutual effects between known passenger h and the unknown future passenger $\check{h}_{j,i+k}$.

This assignment mode has a relatively low complexity, compared to exhaustive searches, is linear in the number of future arrivals, but does not necessarily determine the most optimal assignment for all passengers in the continuation set, because this mode only considers passengers that have arrived at times $t_{i+k}$ before assigning passenger $\check{h}_{j,i+k}$. Due to the low complexity, this is the preferred embodiment of the invention.

Immediate Assignment of the Current Passenger with Reassignment for Future Passengers The immediate assignment mode requires that the assignment for the current passenger is made immediately and never reconsidered. However, there is no such restriction of assignments for the future passengers. This makes it possible, at least in principle, to reconsider the assignment. However, this can lead to a significant increase in computation, and also might not correspond to the way scheduling is performed.

For example, suppose that one of the n continuation sets actually occurs in the future, even though this is not very probable, but not impossible. In that case, the assignments for requests are performed in the immediate mode, and reassignment is not allowed. So, if a good partitioning has been determined in the reassignment mode, then it can be missed in the immediate assignment mode, and that is why reassignment should probably not be used when scheduling future passengers.

Reassignment Mode

When a computationally efficient procedure is available to determine the optimal assignment of an entire continuation set of passengers, it can also be effectively used for Monte Carlo evaluation on the expanded continuation sets $\check{H}_j(t)$ with an associated increase in the computational time.

Regardless of which mode is used, the Monte Carlo scheduling method operates in a rolling horizon manner. After passenger $h_i$ has been assigned (temporarily or permanently) at time $t_i$, using the n sets $\check{H}_j(t_i)$, when the next passenger $h_{i+1}$ arrives at time $t_{i+1}$, new continuation sets $\check{H}_j(t_{i+1})$ are generated from an information vector $I(t_{i+1})$.

A number of options are possible for the format of the information vector I(t) depending on the type of sensing information. A general format that can be used for generation of the Monte Carlo continuation sets is independent of the sensors. This format is a matrix of stochastic processes, specifying an arrival process for each pair of origin and destination floors.

Time-Dependent Poisson Processes

In its simplest form, the information I(t) available at time t includes the most recent estimates of the arrival rates $\lambda_i(t)$ for each floor i. These estimates can be obtained by estimating the number of people boarding cars at particular floors using the sensors 151. The sensor can be a weight sensor in the elevator, a motion sensor at the elevator door, or a camera with a view of the door. To obtain arrival rates $\lambda_{ij}(t)$ for pairs of origin-destination floors, disembarkation rates can also be determined from sensor statistics and iterative proportional fitting. After the arrival rates $\lambda_{ij}(t)$ have been determined and the arrival process is assumed to have a Poisson distribution 300, then it is possible to generate a probability distribution 120 for arrival rates of future passengers characterized by Poisson variables for the continuation set from any starting time 301 as shown in FIG. 3.

Scheduling Passengers using Continuation Sets

Figure 4:
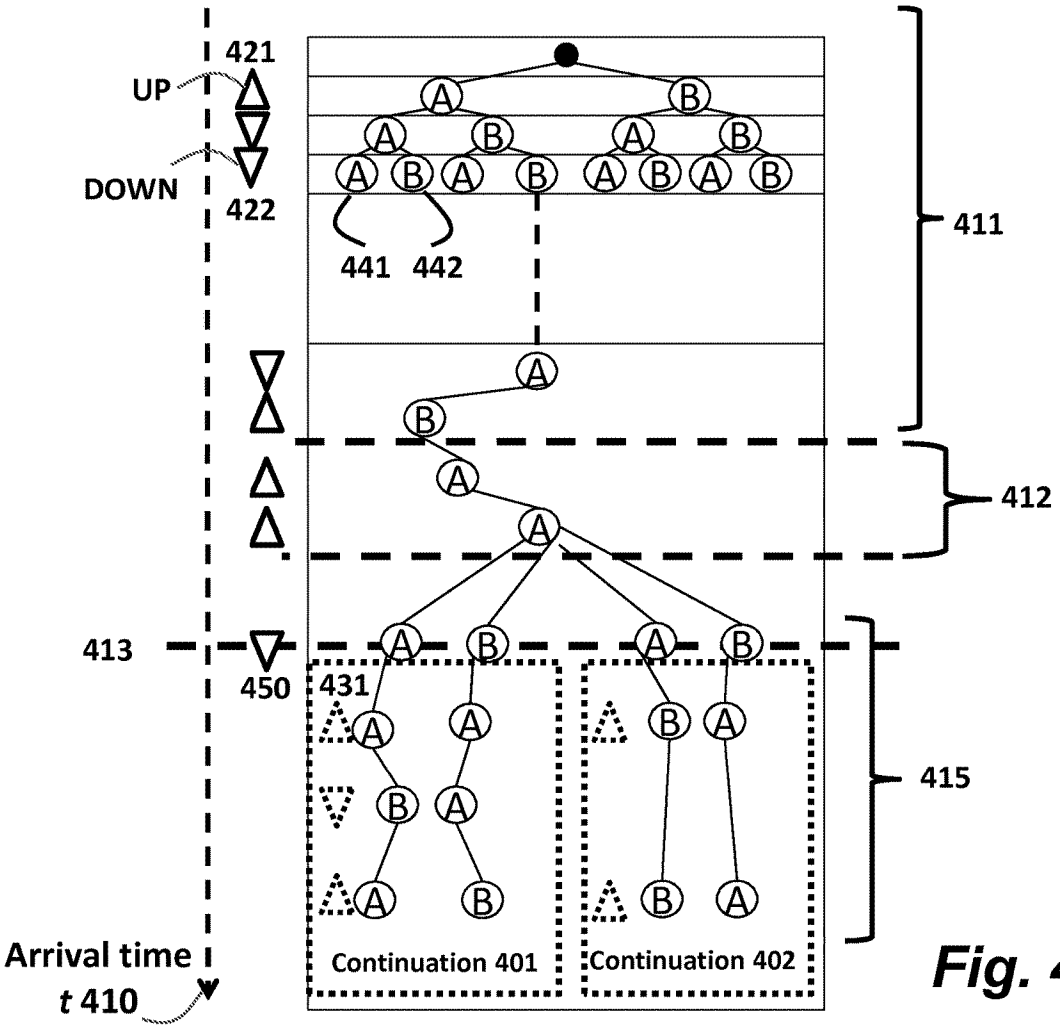
FIG. 4 is a schematic of predictive group elevator scheduling with two continuation sets according to embodiments of the invention.

FIG. 4 is a schematic of predictive group elevator scheduling with two continuation sets 401-402 according to embodiments of the invention. It is understood that there can be any number of continuation sets. In FIG. 4, the arrival time t 410 runs down. The time is partitioned into a time interval 411 for passengers whose requests have been served, a time interval 412 for passengers with assignments that have not yet been served, a current time 413, and a future time interval 415. The solid UP 421 and DOWN 422 symbols indicate request made by already arrived passengers, and the dashed symbols 431 and 432 indicate potential requests by future passengers. The letters A 441 and B 442 represent cars, two in this case. In the time interval 411 the consecutive choice of cars is arranged as a decision tree. During the future time interval 415, it is preferred that requests are fulfilled in immediate assignment mode.

The AWT over all continuation sets is computed for each tentative assignment of the current passenger request 450 (in this case, to either car A or car B), and then the car choice with the shortest AWT is used to make the assignment for the current passenger request 450 at the current time 413. In other words, the scheduler compares how long the existing passenger and a set of possible future passengers would wait, across all possible options (cars) available at the current point in time. The multiple number of continuations ensures that this calculation considers not only one, but many more possible future realizations of the passenger arrival stream, arising from the uncertainty in future arrivals.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

I claim:

1. A method for scheduling elevator cars in a group elevator system in a building, wherein a decision of which an elevator car serves a newly arrived passenger in time is made at a time of arrival of the newly arrived passenger, and not at a later time, comprising steps of:

registering a request for service by the newly arrived passenger by a signal at an elevator landing;

accessing data from a memory, wherein the data includes arrival information of future passengers, wherein the processor is in communication with the memory, and the processor is configured for:

generating a set of probability distributions for arrivals of future passengers at any floor of the building, wherein the set of probability distributions are characterized by probabilistic variables that specify arrival information of the future passengers, wherein the arrival information includes a probability of a number of service requests by the future passengers and a probability of a possible number of times of the service requests;

determining a schedule for the elevator cars based on the set of probabilistic distribution using the arrival information by generating multiple continuation sets from some probabilistic variables of the probabilistic variables for arrivals of future passengers, and determining an optimal elevator car assignment for the newly arrived passenger that registered the request for service, by averaging an average waiting time (AWT) of all newly arrived passengers over all continuation sets, after finding assignments for all future passengers in the continuation sets of the multiple continuation sets; and providing the schedule to a controller of the group elevator system to move the elevator cars according to the schedule, wherein the processor is in communication with the controller.

2. The method of claim 1, wherein the probabilistic variables are determined using a statistical distribution including a Gauss-Bernoulli distribution or a Poisson distribution or an another distribution, that is based on historical passenger arrival information.

3. The method of claim 1, wherein the arrival information is based on arrival history information acquired by sensors, such that the arrival history information includes arrival statistics stored in a table in the memory.

4. The method of claim 1, wherein the scheduling is performed in real time.

5. The method of claim 1, wherein the arrival information is based on arrival history information acquired by sensors in the building, such that the sensors include motion detectors.

6. The method of claim 5, further comprising:

correlating sensed data with actual service requests via registered requests for service by the newly arrived passengers, such that the sensed data includes a sensed presence of potential passengers in other locations of the building.

7. The method of claim 1, wherein the scheduling minimizes an average waiting time.

8. The method of claim 1, wherein schedule includes passengers that have made requests for service.

9. The method of claim 1, wherein the probability distributions for arrival times of the future passengers are characterized by Gauss-Bernoulli variables.

10. The method of claim 1, wherein the probability distributions for arrival rates of the future passengers are characterized by Poisson variables.

11. The method of claim 1, further comprising:

sampling the arrival information to generate multiple continuation sets, wherein each continuation set includes information about assigned waiting passengers, a current requesting passenger, and future passengers, and wherein arrival of future passenger arrivals are sampled from the set of probability distributions.

12. The method of claim 11, wherein a length of the continuation sets vary from minutes to hours, and further comprising:

determining an optimal cumulative waiting time for all continuation sets, over all possible assignments of the passengers represented in the multiple continuation sets.

13. The method of claim 11, wherein the current requesting passenger and the future passengers are all scheduled in an immediate assignment mode.

14. The method of claim 11, wherein the current requesting passenger is scheduled in an immediate assignment mode, and the future passengers are scheduled in a reassignment mode.

15. The method of claim 11, wherein the current requesting passenger and the future passengers are all scheduled in a reassignment mode.

16. A system for scheduling elevator cars in a group elevator system in a building, wherein a decision of which an elevator car serves a newly arrived passenger in time is made at a time of arrival of the newly arrived passenger, and not at a later time, comprising:

a memory having stored data including arrival information of future passengers;

a processor in communication with the memory, is configured to:

register a request for service by the newly arrived passenger by a signal at an elevator landing;

generate probability distributions for arrivals of future passengers at any floor of the building, wherein the probability distributions are characterized by probabilistic variables that specify arrival information of the future passengers, wherein the arrival information includes a probability of a number of service requests by the future passengers and a probability of a possible number of times of the service requests;

determine a schedule for the elevator cars based on the probabilistic distributions using the arrival information by generating multiple continuation sets from some probabilistic variables of the probabilistic variables for arrivals of future passengers, and determining an optimal elevator car assignment for the newly arrived passenger that registered the request for service, by averaging an average waiting time (AWT) of all newly arrived passengers over all continuation sets, after finding assignments for all future passengers in the continuation sets of the multiple continuation sets; and a controller of the group elevator system to move the elevator cars according to the schedule.

17. A method for scheduling elevator cars in a group elevator system in a building, wherein a decision of which an elevator car serves a newly arrived passenger in time is made at a time of arrival of the newly arrived passenger, and not at a later time, comprising:

registering a request for service by the newly arrived passenger by a signal at an elevator landing;

accessing data from a memory, wherein the data includes arrival information of future passengers, wherein the processor in communication with the memory, is configured for:

generating a set of probability distributions for arrivals of future passengers at any floor of the building, wherein the set of probability distributions are characterized by probabilistic variables that specify arrival information of the future passengers, wherein the arrival information includes a probability of a number of service requests by the future passengers and a probability of a possible number of times of the service requests;

determining a schedule for the elevator cars based on the set of probabilistic distribution using the arrival information by generating multiple continuation sets from some probabilistic variables of the probabilistic variables for arrivals of future passengers;

determining an optimal elevator car assignment for the newly arrived passenger that registered the request for service; and providing the schedule to a controller of the group elevator system to move the elevator cars according to the schedule, wherein the processor is in communication with the controller.

18. The system of claim 17, wherein determining the optimal elevator car assignment for the newly arrived passenger that registered the request for service is by averaging an average waiting time (AWT) of all newly arrived passengers over all continuation sets, after finding assignments for all future passengers in the continuation sets of the multiple continuation sets.

19. The method of claim 17, wherein the probabilistic variables are determined using a statistical distribution including a Gauss-Bernoulli distribution or a Poisson distribution or an another distribution, that is based on historical passenger arrival information.

20. The method of claim 17, wherein the arrival information is based on arrival history information acquired by sensors, such that the arrival history information includes arrival statistics stored in a table in the memory.

* * * * *